US006164054A

United States Patent [19]

Matas Gabalda et al.

[11] Patent Number: 6,164,054

[45] Date of Patent: Dec. 26, 2000

[54] MACHINE FOR THE SPINNING AND TEXTURING OF THREADS BY FALSE TWISTING

[75] Inventors: Carlos Matas Gabalda, Granges les Valence; Jean-Claude Dupeuple, Saint Genis Laval, both of France

[73] Assignee: ICTB Yarn SA, Roanne, France

[21] Appl. No.: 09/247,398

[22] Filed: Feb. 10, 1999

[30] Foreign Application Priority Data

Feb. 26, 1998 [FR] France ..... 98 02573

[51] Int. Cl.[7] ..... D01H 7/46

[52] U.S. Cl. ..... 57/290; 57/291; 57/284; 57/308; 57/352; 28/221; 28/245; 28/287; 264/103

[58] Field of Search ..... 57/291, 284, 290, 57/279, 282, 308, 352, 34; 264/168, 103; 425/72.2; 28/221, 245, 287

[56] References Cited

U.S. PATENT DOCUMENTS

| | | | |
|---|---|---|---|
| 4,051,650 | 10/1977 | Gleyze et al. . | |
| 4,648,240 | 3/1987 | Hallsworth et al. . | |
| 4,719,745 | 1/1988 | Konig | 57/291 |
| 4,809,494 | 3/1989 | Dammann . | |
| 5,644,908 | 7/1997 | Schippers et al. | 57/290 |
| 5,700,490 | 12/1997 | Meis | 425/72.2 |

FOREIGN PATENT DOCUMENTS

| | | |
|---|---|---|
| 2130337 | 11/1972 | France . |
| 2170099 | 9/1973 | France . |
| 2341677 | 9/1977 | France . |
| 2666353 | 3/1992 | France . |
| 2736937 | 1/1997 | France . |
| 2903523 | 8/1980 | Germany . |

*Primary Examiner*—John J. Calvert
*Assistant Examiner*—Mary K. Fiore
*Attorney, Agent, or Firm*—Wall Marjama & Bilinski

[57] ABSTRACT

Machine for spinning and texturing by false twisting, in which the false-twist zone comprises a plurality of identical texturing stations arranged side by side on a common frame, each station comprising in order, with regard to the displacement of the thread (2) during its texturing treatment:

- a first delivery (3) associated, if appropriate, with a system for drawing the thread (2) and making it possible to deliver the thread to be textured;
- a heating device (4) followed by a cooling zone (5) for the heated thread;
- a false-twist spindle (6);
- a second take-up (7) for the textured thread emerging from the false-twist spindle (6);
- if appropriate, a third take-up (8) of the thread, downstream of which is arranged a second thermal treatment zone (9), and;
- a final take-up arranged immediately in front of the receiving members, wherein the feed of threads to all the texturing stations is carried out from means for the spinning and drawing of chemical threads, which means are mounted on said texturing machine, the threads produced being introduced directly into the first deliveries (3) of the texturing zone after they have emerged from the spinning/drawing assembly.

5 Claims, 6 Drawing Sheets

MACHINE FOR THE SPINNING AND TEXTURING OF THREADS BY FALSE TWISTING

TECHNICAL FIELD

The present invention relates to an improved machine which makes it possible to carry out continuously the spinning of chemical threads, their drawing and their texturing.

PRIOR ART

As may be gathered especially from the French patents 2 130 337, 2,170,099 and 2,341,677, it has been proposed, for a very long time, to carry out continuously the operations of spinning, drawing and texturing, especially by false twisting, of synthetic threads made of polypropylene, polyester, polyamide, etc.

This technique, although attractive, has been implemented, at least to the Applicant's knowledge, only for carrying out texturing treatment by wadding chamber (the Banlon method), by blowing nozzle (the Taslan method) or by crimping by passage over an edge (the Agilon method).

By contrast, it is not suitable for producing threads textured by false twisting, in view of the fact that the production speeds of chemical threads and those of false-twist texturing machines were not compatible with one another, at least at the outset, unless it was accepted that the spinning and drawing assembly would be considerably underused, the latter hitherto being designed to have a winding speed of the thread produced of the order of several thousand meters per minute, whereas the winding of a texturing machine generally takes place at approximately 1000 meters per minute.

Consequently, if an average person skilled in the art envisaged arranging a texturing machine at the exit of a spinning/drawing assembly, this would have resulted, in view of the winding speed of such texturing machines and of the drawing rate applied to the threads in this zone, in feeding the texturing machine at a speed of the order of a few hundred meters per minute, for example between 400 and 600 meters per minute, depending on the threads, thus corresponding to an equivalent speed at the exit of the spinning and drawing installation, said speed therefore being at least four times lower than that of conventional spinning/drawing installations.

Moreover, the very design of spinning and drawing installations would have led an average person skilled in the art to produce assemblies of large overall size which would be virtually unworkable on an industrial scale and, above all, would not have made it possible, where appropriate, to use the false-twist texturing machine in a conventional way, with a feed from non-drawn or partially drawn threads carried by conventional feed bobbins.

PRESENTATION OF THE INVENTION

An improvement to machines making it possible to obtain threads textured by false twisting was found, then, this being the subject of the present invention, which not only has a structure such that, whilst having a minimum overall size so that an operator has direct access to the treatment members, it makes it possible to carry out the feed of said machine both directly at the exit of an assembly for the spinning and drawing of any chemical thread and from partially drawn or non-drawn threads previously produced and supported by a creel arranged at the rear of the machine.

In general terms, the machine according to the invention is of the type of false-twist texturing machines which have a reduced overall size, especially in terms of height, and which, moreover, make it possible to preserve a substantially linear passage of the thread from entry into the thermal treatment oven to the spindle imparting the false twist.

Such machines, the general structure of which may be gathered especially from the patents U.S. Pat. Nos. 4,051,650 and 4,332,132, consist essentially of a plurality of identical texturing stations arranged side by side on a common frame, each station comprising in order, with regard to the displacement of the thread during the texturing treatment:

- a first delivery associated, if appropriate, with a system for drawing the thread and making it possible to deliver the thread to be textured;
- a heating device followed by a cooling zone for the heated thread;
- a false-twist spindle;
- a second take-up for the textured thread emerging from the false-twist spindle;
- if appropriate, a third take-up of the thread, downstream of which is arranged a second thermal treatment zone, and;
- a final take-up arranged immediately in front of the receiving members.

In general, in such machines, the thread feed and the receiving zone, associated, if appropriate, with the thermal resetting zone, are arranged one opposite the other on either side of a service zone for the passage of the personnel, the first delivery/oven/ cooling stage and false-twist spindle being substantially aligned and arranged above the service zone, the thread which comes from the feed assembly being introduced into the oven either directly or, when the first oven and the cooling stage are inclined relative to the horizontal and partly surmount the feed zone, by the intermediary of thread guide means consisting essentially of a reentry tube which is in proximity to the first delivery and the exit of which is connected to the entrance of the oven (U.S. Pat. No. 4,051,650), or by the intermediary of a launching assembly comprising an orientable guide making it possible to introduce the thread into the oven when the latter is open, as may be gathered from U.S. Pat. No. 4,332,132.

An improvement to such texturing machines was found, then, this being the subject of the present invention, which not only makes it possible to feed the texturing stations from bobbins mounted on a creel or rack, but, above all, allows the texturing members to be fed directly from means for the spinning and drawing of chemical threads, which means are mounted on said texturing machine, the threads produced being introduced directly into the first delivery of the texturing zone after they have emerged from the spinning/drawing assembly.

The machine according to the invention is defined in that the texturing stations are arranged in the form of two groups comprising a specific number of workstations, each group being arranged on either side of a central plane of symmetry forming a longitudinal corridor, the thread feed means consisting of a cell for spinning and drawing a plurality of chemical threads corresponding to the number of threads treated, the spinning means being arranged above the frame of the machine and the drawing means being arranged at the end in the central corridor, the extruded and drawn threads being distributed to the take-up deliveries of the texturing zone symmetrically on either side of the plane of symmetry by means of drawing and guide rollers arranged in the lower part of the machine substantially in line with the first delivery of the texturing section.

BRIEF DESCRIPTION OF THE DRAWINGS

The accompanying drawings illustrate two embodiments of a machine produced according to the invention, each embodiment being represented by three similar figures, namely.

In the rest of the description, the same references will be used to designate the same elements of each type of machine.

EMBODIMENT OF THE INVENTION

Figure 1:
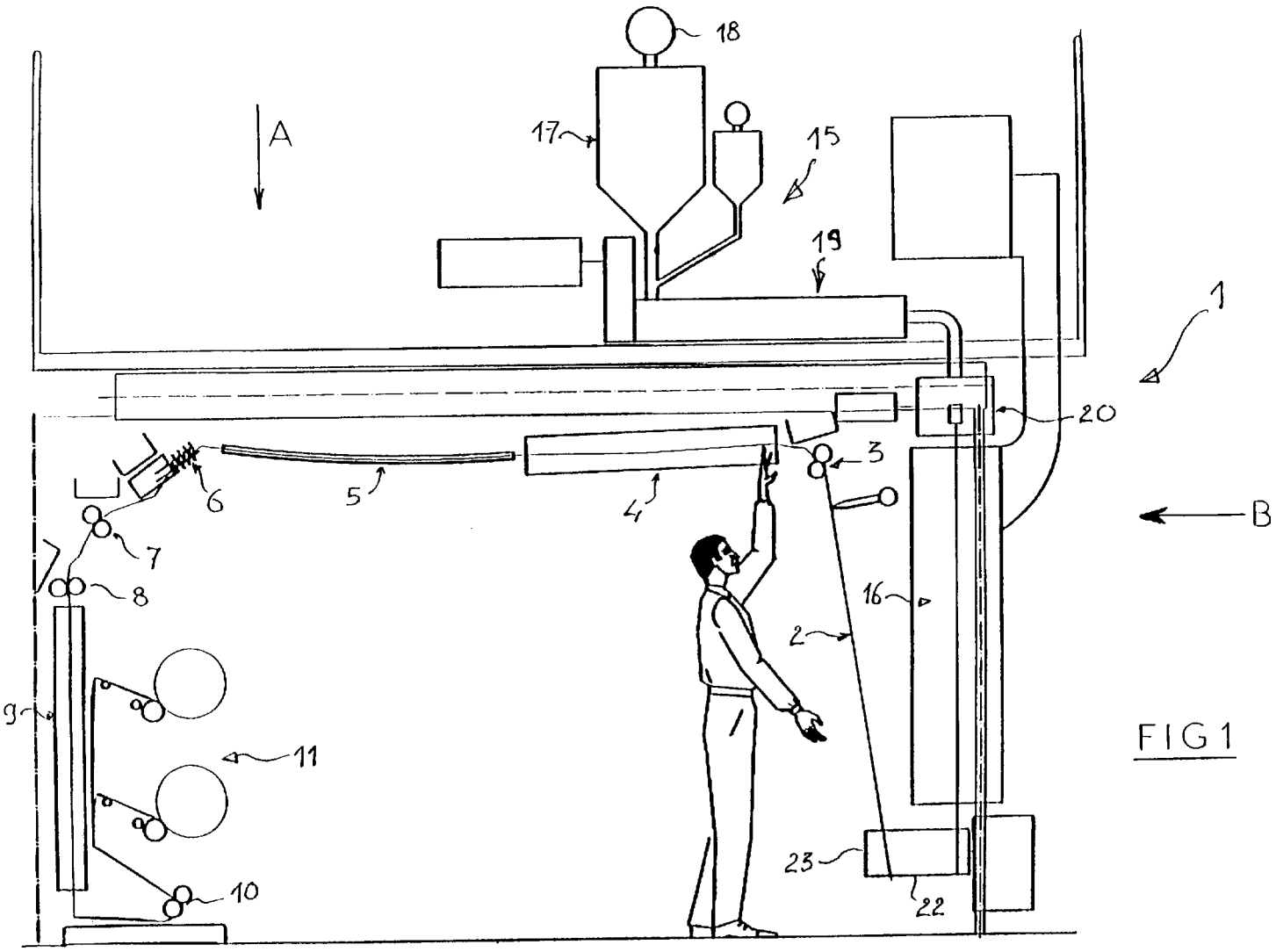
FIGS. 1 and 4: side elevation views.

Referring to the accompanying figures, the machine according to the invention is therefore composed essentially of a plurality of identical texturing stations arranged side by side on a common frame.

Such a machine comprises, in a known way, a feed, designated by the general reference (1), for threads (2) to be textured.

The first active texturing member consists of a first delivery (3), followed by a heating device (4), by a cooling zone (5) and by a false-twist spindle (6).

A second take-up or delivery (7) for the textured thread is arranged at the exit of the false-twist spindle (6).

Said textured thread can then either be conveyed directly to the winding members (11) by means of a take-up (10) or undergo a second thermal treatment in a second heating device (9) which is then preferably preceded by a third take-up (8).

In the machine according to the invention, the thread feed (1) and the receiving zone (11), the latter being preceded, if appropriate, by the thermal resetting means (8, 9), are arranged on either side of a central service zone for the passage of the personnel, the first oven (4), the cooling zone (5) and the spindle (6) being substantially aligned and arranged at least partially above said service zone.

Figure 2:
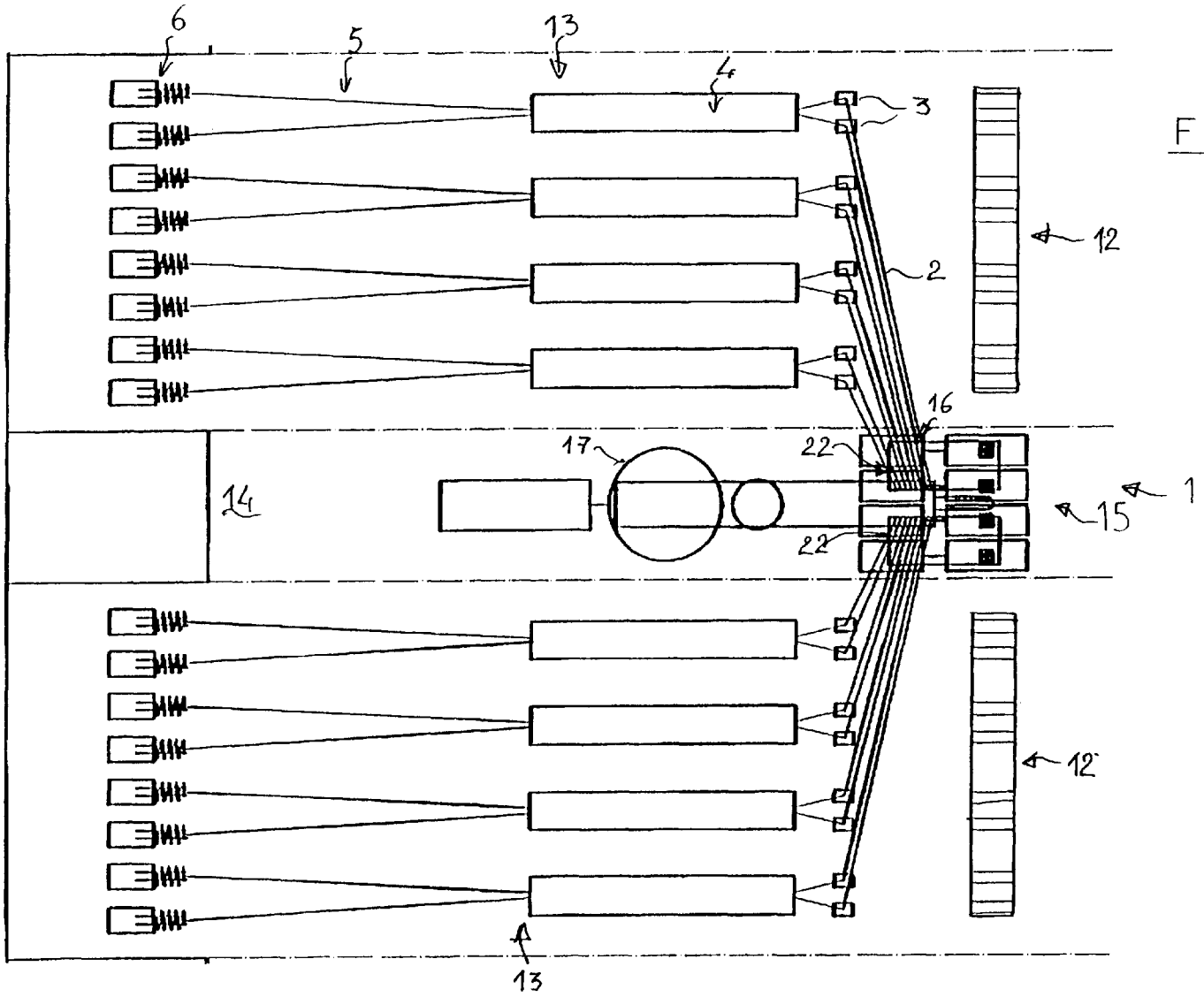
FIGS. 2 and 5: top views according to A of FIGS. 1 and 4.
Figure 3:
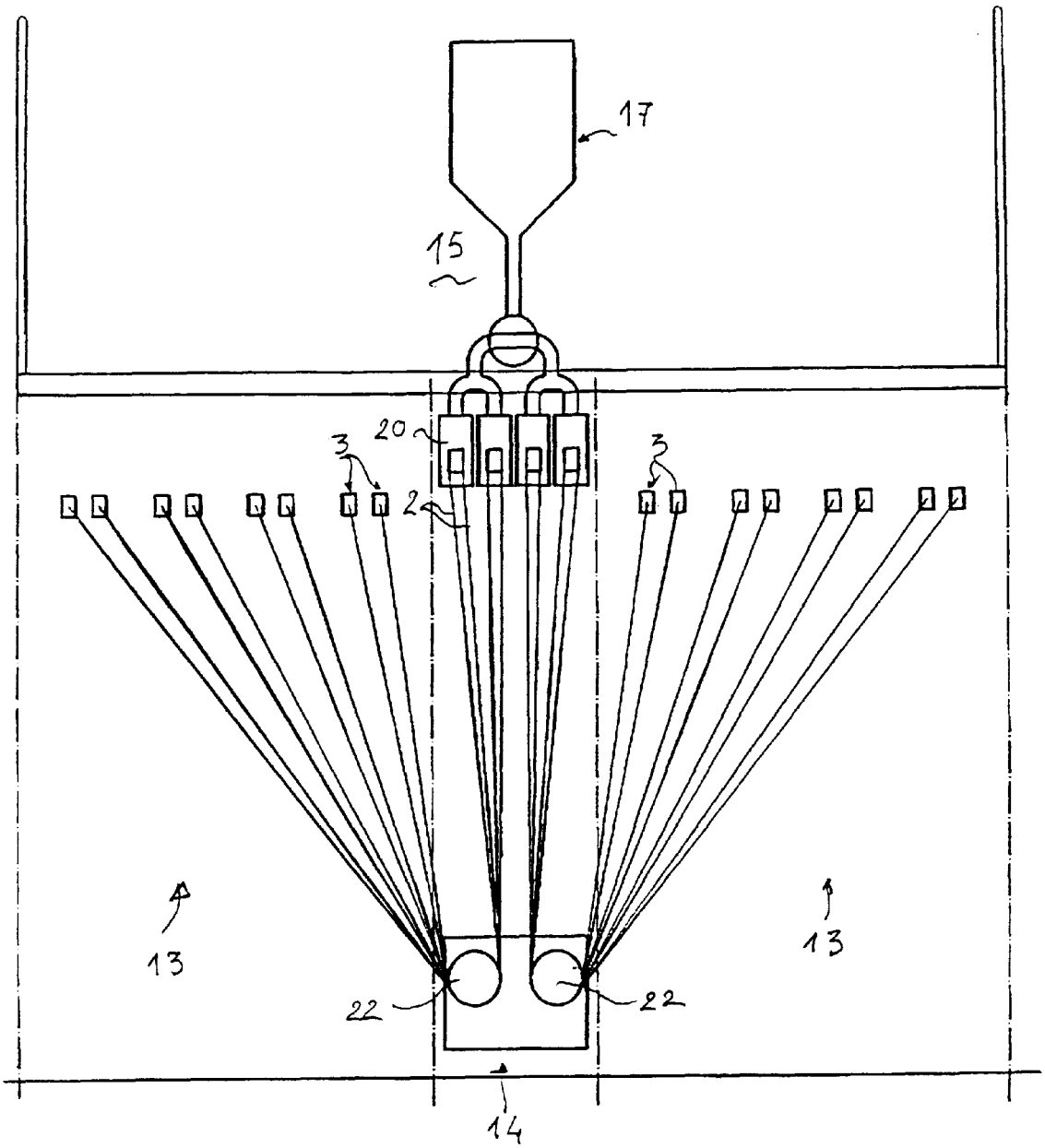
FIGS. 3 and 6: front views according to B of FIGS. 1 and 4.

In a first embodiment illustrated in FIGS. 1 to 3, the thread feed (2) is carried out by positioning the first delivery (3) in the vicinity of the entrance of the first oven (4).

Figure 4:
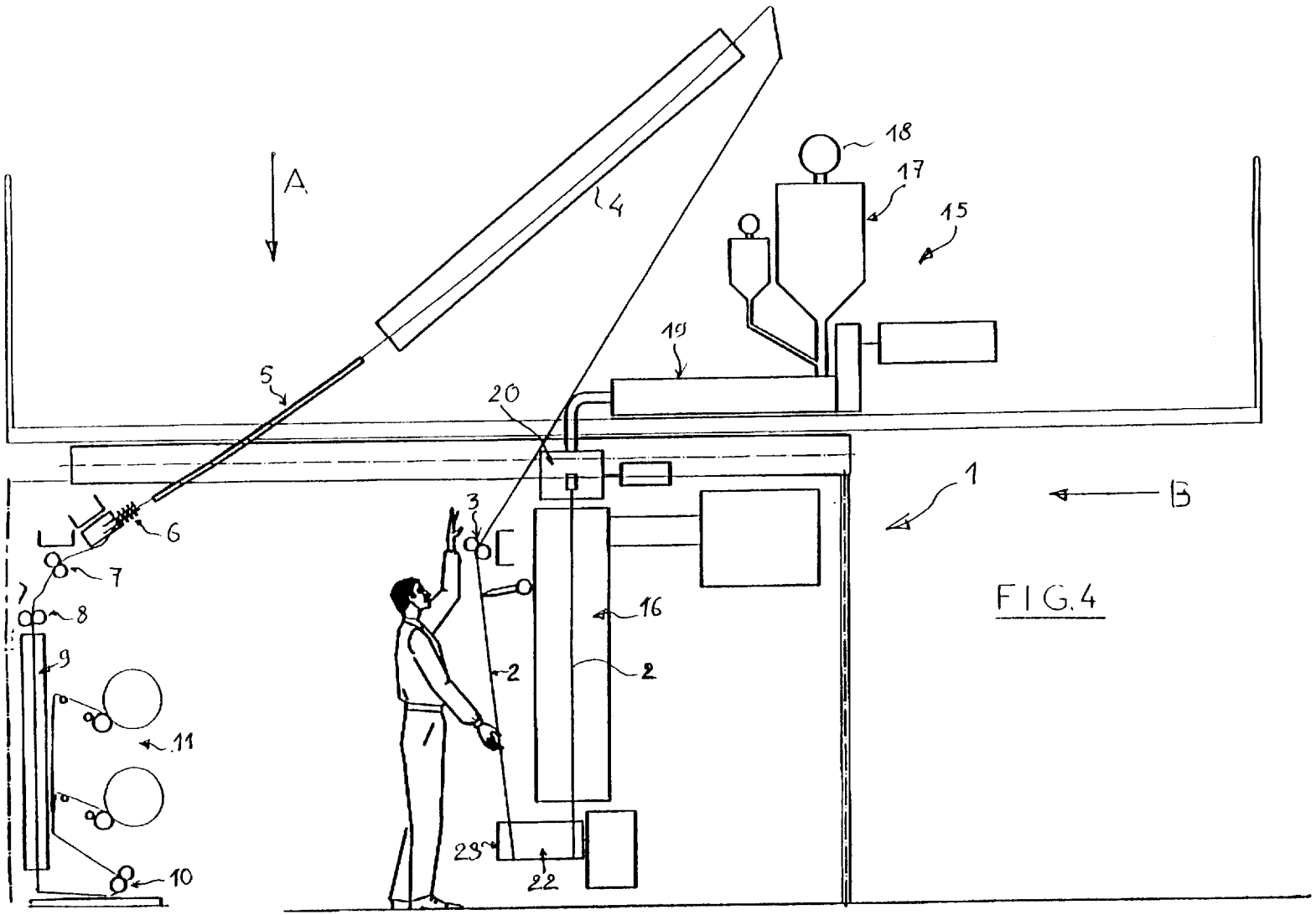
Figure 5:
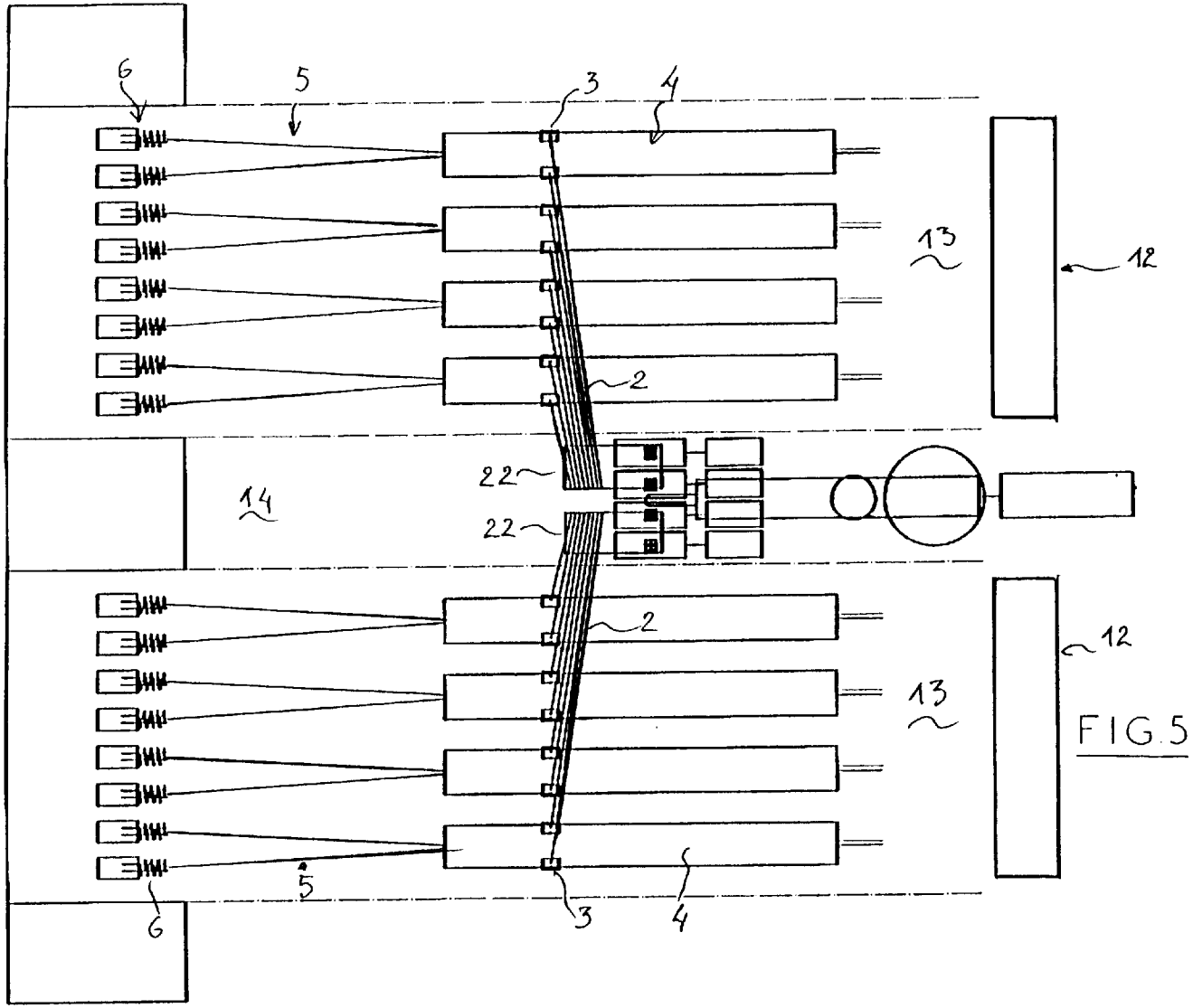
Figure 6:
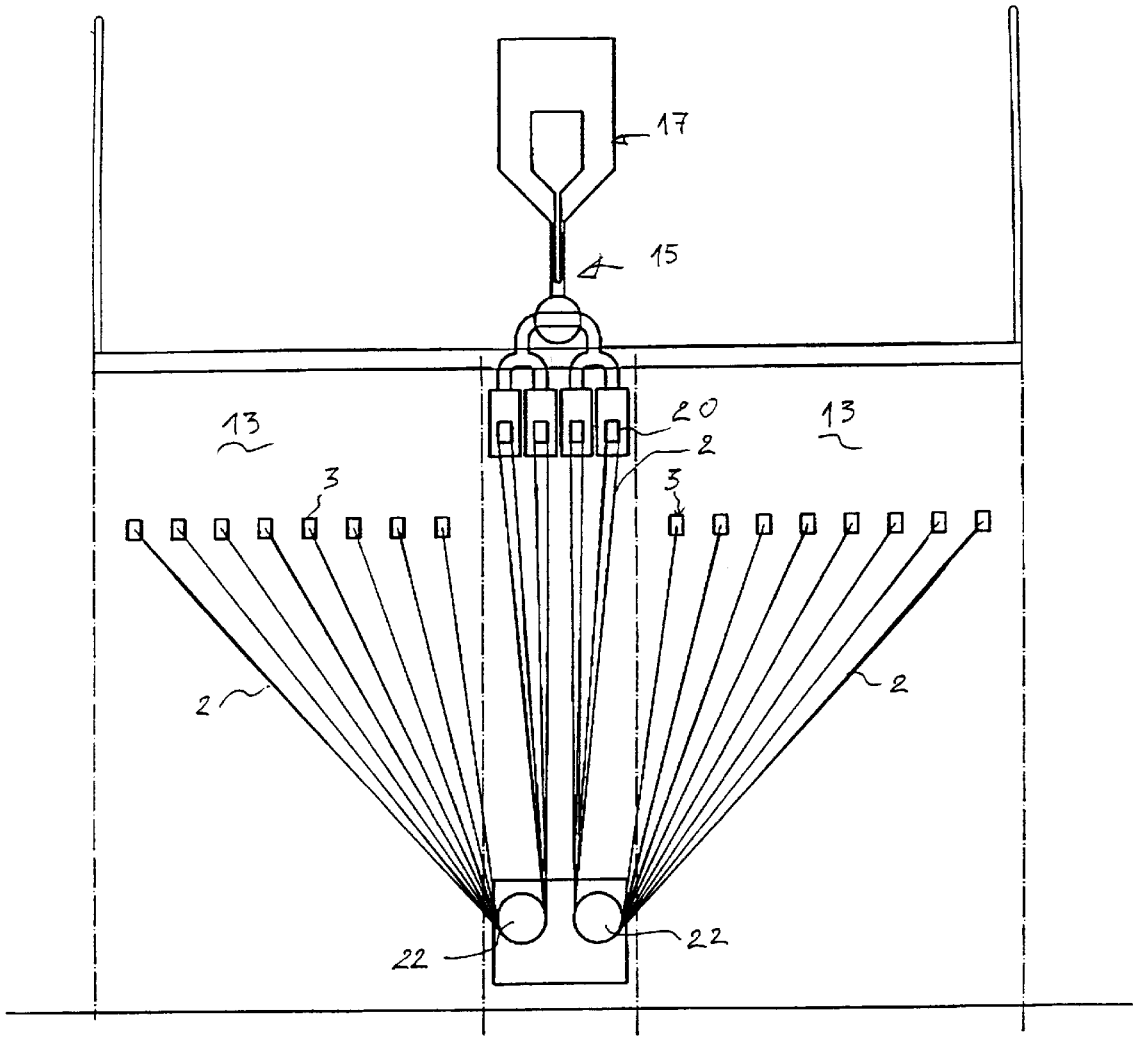

In a second embodiment illustrated in FIGS. 4 and 6, the texturing members, oven (4)/cooling stage (5) and spindle (6), are inclined relative to the horizontal, and means are therefore provided to make it possible to introduce the thread into the oven, the first delivery (3) still being directly accessible to the user. Such a structure of the machine may be produced according to the teachings of the patents U.S. Pat. Nos. 4,051,650 or 4,332,132.

According to an essential characteristic of the invention, such a machine has a structure which also makes it possible to carry out the feed of threads (2) to be textured from bobbins mounted on a creel or rack designated by the reference (12) and indicated diagrammatically in FIGS. 2, 3 and 5, 6, and the threads can be non-drawn, partially drawn or drawn threads from an assembly, designated by the general reference (15), for the spinning and drawing of chemical threads, which assembly is mounted on said texturing machine, the threads produced being introduced directly into the first delivery (3) of the texturing zone after they have emerged from the spinning/drawing assembly.

As may be gathered from the accompanying figures, according to the invention, in order to make it possible to feed threads to the texturing stations both from threads previously produced and stored on bobbins and from a spinning and drawing cell, in the machine according to the invention the texturing stations are arranged in the form of two groups, designated by the same reference (13), comprising a specific number of workstations, each group (13) being arranged on either side of a central corridor (14).

In the present case, each texturing group (13) comprises eight stations, moreover the ovens (4) being designed to treat two threads simultaneously.

Of course, this is not limiting, and it would be conceivable to produce machines comprising a larger or smaller number of texturing stations.

At the end of this central corridor (14) are arranged the spinning (15) and drawing (16) means which make it possible to feed the texturing stations continuously.

The spinning means (15) are conventional means.

They are composed essentially of a stock (17) of granules of material to be spun (polyolefine, polyamide, etc.), this stock (17) being fed from storage silos common to a plurality of machines by means of a distribution conduit (18). This stock (17) feeds a screw-type extruder (19) which delivers the melted material to a spinning can (20) by means of a pump. In the present case, the spinning assembly comprises a die making it possible to produce 16 elementary threads (2) simultaneously, thus making it possible to feed threads to the eight texturing stations arranged on either side of the central corridor (14). If appropriate, the polymer may be colored during this spinning phase.

At the exit of the die, the threads are drawn at (21) in a vertically arranged drawing chamber and are distributed in two groups by being passed around two rotary drums (22) which may either be of the heating type or be at ambient temperature, depending on the spun material.

The threads form one or more turns around the drums (22) and are subsequently introduced individually into the first take-up (3) of each texturing station, the latter being produced conventionally.

It is expedient to note that the guide drums or rollers (22) are arranged in the lower part of the machine, their end (23) being virtually in line with the first delivery (3) of the texturing section. This rotary drum (27) therefore makes it possible to ensure that the extruded threads are drawn partially or completely and are guided to the texturing machine.

In the two exemplary embodiments illustrated, the only difference is in the positioning of the spinning means which are arranged in the upper part of the machine.

Such a machine, which is of particularly simple design, thus makes it possible to produce a false-twist texturing assembly which may be fed with threads both from thread bobbins previously produced and from a spinning/drawing assembly associated directly with the texturing means.

Of course, the invention is not limited to the two actual exemplary embodiments illustrated, but embraces all the variants produced in the same spirit.

What is claimed is:

1. A machine for spinning and texturing by false twisting, in which a false-twist zone comprises a plurality of identical texturing stations arranged side by side on a common frame, each station comprising in order, with regard to the displacement of a thread (2) during its texturing treatment:

a first take-up delivery (3) associated with a system for drawing the thread (2) and making it possible to deliver the thread to be textured;

a heating device (4) followed by a cooling zone (5) for the heated thread;

a false-twist spindle (6);

a second take-up delivery (7) for the textured thread emerging from the false-twist spindle (6); and a final take-up arranged immediately in front of a plurality of receiving members, wherein the feed of threads to all the texturing stations is carried out from feed means for the spinning and drawing of chemical threads, said feed means including spinning means (15) for spinning the threads and drawing means (16) for drawing the threads, which feed means are mounted on said texturing machine, the threads produced being introduced directly into the first take-up deliveries (3) of a texturing zone after they have emerged from the feed means.

2. The machine as claimed in claim 1, wherein the texturing stations are arranged in the form of two groups (13) comprising a specific number of stations, each group being arranged on either side of a plane of symmetry forming a longitudinal corridor (14), the feed means including a number of spinning means (15) for the spinning of a plurality of chemical threads corresponding to the number of threads treated, the spinning means (15) being arranged above the frame of the machine and the drawing means (16) being arranged at an end in the longitudinal corridor (14), the extruded and drawn threads (2) being distributed to the take-up delivery (3) of the texturing zone symmetrically on either side of the plane of symmetry by means of two drawing and guide rollers (22) arranged in the lower part of the machine substantially in line with a vertical plane passing through the first take-up delivery (3) of the texturing zone.

3. The machine as claimed in claim 1, which also comprises means for carrying out the feed of threads to the false-twist zone from bobbins mounted on a creel (12).

4. The machine as claimed in claim 2, which also comprises means for carrying out the feed of threads to the false-twist zone from bobbins mounted on a creel (12).

5. The machine as claimed in claim 1, further comprising a third take-up delivery (8) of the thread, downstream of which is arranged a second thermal treatment zone (9).

* * * * *